US011885593B2

(12) United States Patent
Libotte

(10) Patent No.: US 11,885,593 B2
(45) Date of Patent: Jan. 30, 2024

(54) MOUNTING RAIL FOR FIREARM

(71) Applicant: FN HERSTAL S.A., Herstal (BE)

(72) Inventor: Hugues Libotte, Jalhay (BE)

(73) Assignee: FN HERSTAL S.A., Herstal (BE)

( * ) Notice: Subject to any disclaimer, the term of this patent is extended or adjusted under 35 U.S.C. 154(b) by 0 days.

(21) Appl. No.: 17/782,019

(22) PCT Filed: Dec. 10, 2020

(86) PCT No.: PCT/EP2020/085581
§ 371 (c)(1),
(2) Date: Jun. 2, 2022

(87) PCT Pub. No.: WO2021/116310
PCT Pub. Date: Jun. 17, 2021

(65) Prior Publication Data

US 2023/0023146 A1 Jan. 26, 2023

(30) Foreign Application Priority Data

Dec. 11, 2019 (EP) ..... 19215191

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 5,033,219 A * 7/1991 Johnson ..... F41G 1/35 42/126
5,669,174 A * 9/1997 Teetzel ..... F41G 1/36 89/41.17
5,822,905 A * 10/1998 Teetzel ..... F41G 1/36 42/117
6,622,416 B2 * 9/2003 Kim ..... F41G 1/35 42/114

(Continued)

FOREIGN PATENT DOCUMENTS

WO 2011079233 A2 6/2011

OTHER PUBLICATIONS

International Search Report and Written Opinion of the International Searching Authority from the European Patent Office, in PCT/EP2020/085581 dated Mar. 22 2021, which is an international application corresponding to this U.S. application.

*Primary Examiner* — Michelle Clement
(74) *Attorney, Agent, or Firm* — Kolitch Romano Dascenzo Gates LLC

(57) ABSTRACT

A mounting rail for a firearm is described, wherein the rail includes at least one catch arranged on a flat upper surface of the rail. The at least one catch serves as a means of fixation for at least one accessory. The rail also includes a housing that extends longitudinally, and the housing is suited to receive a printed circuit board allowing for an electrical connection with the accessory. The housing is partially defined by at least one recess, each recess being arranged between two opposite flanks of the corresponding catch. A top of the corresponding catch extends transversely on either side of a median plane of the rail above the housing.

13 Claims, 4 Drawing Sheets

(56) References Cited

U.S. PATENT DOCUMENTS 6,779,288 B1 * 8/2004 Kim ..... F41G 11/003 42/75.01
6,931,775 B2 * 8/2005 Burnett ..... F41G 3/02 42/106
RE39,465 E * 1/2007 Swan ..... F41C 23/16 42/75.01
7,243,454 B1 * 7/2007 Cahill ..... F41C 23/16 42/72
7,438,430 B2 * 10/2008 Kim ..... F41G 11/003 200/18
7,464,495 B2 * 12/2008 Cahill ..... F41C 23/12 42/72
7,525,203 B1 * 4/2009 Racho ..... H02K 35/02 310/12.24
7,548,697 B2 * 6/2009 Hudson ..... H04Q 9/00 398/107
7,559,169 B2 * 7/2009 Hung ..... F41G 1/32 42/146
7,584,569 B2 * 9/2009 Kallio ..... F41G 1/35 42/117
7,627,975 B1 * 12/2009 Hines ..... F41G 11/003 42/84
7,640,690 B2 * 1/2010 Hines ..... F41C 23/16 42/84
7,676,975 B2 * 3/2010 Phillips ..... F41C 23/16 42/72
7,730,820 B2 * 6/2010 Vice ..... F41C 23/22 42/70.01
7,818,910 B2 * 10/2010 Young ..... F41C 23/16 42/106
7,841,120 B2 * 11/2010 Teetzel ..... F41A 23/08 42/72
7,866,083 B2 * 1/2011 Teetzel ..... F41G 1/35 42/117
7,908,784 B2 * 3/2011 Kim ..... F41G 11/003 42/146
7,953,369 B2 * 5/2011 Baarman ..... H02J 50/12 307/145
7,975,419 B2 * 7/2011 Darian ..... F41C 27/00 42/84
7,994,752 B2 * 8/2011 Soar ..... H02J 7/0044 320/108
8,028,459 B2 * 10/2011 Williams ..... F41G 11/003 42/106
8,028,460 B2 * 10/2011 Williams ..... F41G 11/003 42/84
8,091,265 B1 * 1/2012 Teetzel ..... F41C 23/16 42/71.01
8,104,211 B2 * 1/2012 Darian ..... F41C 27/00 42/84
8,141,288 B2 * 3/2012 Dodd ..... F41C 23/22 42/72
8,146,282 B2 * 4/2012 Cabahug ..... F41C 23/22 42/72
8,151,505 B2 * 4/2012 Thompson ..... F41C 27/00 42/84
8,225,542 B2 * 7/2012 Houde-Walter ..... F41C 23/16 42/72
8,322,064 B2 * 12/2012 Cabahug ..... F41C 27/00 42/71.01
8,347,541 B1 * 1/2013 Thompson ..... F41G 11/003 42/84
8,397,418 B2 * 3/2013 Cabahug ..... F41C 27/00 42/72
8,402,683 B2 * 3/2013 Cabahug ..... F41C 23/04 42/71.01
8,413,362 B2 * 4/2013 Houde-Walter ..... F41G 11/003 42/84
8,443,539 B2 * 5/2013 Cabahug ..... F41G 11/003 42/71.01
8,448,368 B2 * 5/2013 Cabahug ..... F41G 11/003 42/72
8,458,944 B2 * 6/2013 Houde-Walter ..... F41C 23/16 42/72
8,464,459 B1 * 6/2013 Summers ..... F41A 17/063 42/70.08
8,490,313 B2 * 7/2013 Frascati ..... F41G 11/003 42/72
8,516,731 B2 * 8/2013 Cabahug ..... F41G 11/003 42/72
8,635,798 B2 * 1/2014 Mulfinger ..... H01R 13/24 42/84
8,769,856 B2 * 7/2014 Berntsen ..... F41G 11/003 42/84
8,776,422 B2 * 7/2014 Dodd ..... F41G 11/003 42/72
8,919,025 B2 * 12/2014 Kuczynko ..... F41A 5/18 42/71.01
9,200,867 B1 * 12/2015 Swan ..... F41C 23/16
9,279,639 B2 * 3/2016 Hines ..... F41C 23/22
9,285,185 B2 * 3/2016 Cabahug ..... F41C 27/00
10,337,836 B2 * 7/2019 Righi ..... F41G 11/003
10,458,754 B2 * 10/2019 Miller ..... F41G 3/02
10,477,618 B2 * 11/2019 Downing ..... F41G 9/00
10,551,149 B2 * 2/2020 Teetzel ..... F41G 11/003
10,557,687 B2 * 2/2020 Teetzel ..... F41G 1/34
10,578,396 B2 * 3/2020 Teetzel ..... F41G 11/003
10,712,123 B2 * 7/2020 Williams ..... F41C 23/16
10,753,709 B2 * 8/2020 Neal ..... G02B 6/4206
10,809,038 B2 * 10/2020 Geissele ..... F41C 23/16
10,871,344 B2 * 12/2020 Brown, Jr. ..... F41C 23/04
10,976,131 B1 * 4/2021 Cabahug ..... F41C 23/16
10,982,927 B2 * 4/2021 Bonesteel ..... F41C 23/16
11,067,367 B2 * 7/2021 Delgado Acarreta ... H04L 67/61
11,085,714 B2 * 8/2021 Doll ..... F41G 11/003
11,131,525 B2 * 9/2021 Williams ..... F41C 23/16
11,156,420 B1 * 10/2021 Clark ..... F41C 23/16
11,162,763 B2 * 11/2021 Masarik ..... F41G 11/003
11,231,253 B2 * 1/2022 Miller ..... F41C 23/22
11,262,167 B2 * 3/2022 Ding ..... F41G 11/003
2002/0191282 A1 * 12/2002 Edwards ..... F41G 1/38 359/405
2008/0134562 A1 * 6/2008 Teetzel ..... F41G 1/35 42/114
2009/0108589 A1 * 4/2009 Racho ..... H02K 7/1876 290/1 R
2010/0031552 A1 * 2/2010 Houde-Walter ..... F41C 23/16 42/72
2010/0083553 A1 * 4/2010 Montgomery ..... F41C 27/00 42/84
2010/0154276 A1 * 6/2010 Kim ..... F41C 27/00 42/108
2010/0175293 A1 * 7/2010 Hines ..... F41C 23/16 42/71.01
2010/0180485 A1 * 7/2010 Cabahug ..... F41C 27/00 42/90
2010/0192443 A1 * 8/2010 Cabahug ..... F41C 23/16 42/71.01
2010/0192444 A1 * 8/2010 Cabahug ..... F41G 11/003 42/71.01
2010/0192446 A1 * 8/2010 Darian ..... F41G 11/003 320/108
2010/0192448 A1 * 8/2010 Darian ..... F41G 11/003 42/84
2010/0218410 A1 * 9/2010 Cabahug ..... F41C 23/16 42/71.01
2010/0242332 A1 * 9/2010 Teetzel ..... F41A 23/22 42/72
2010/0275489 A1 * 11/2010 Cabahug ..... F41C 23/04 42/71.01
2010/0281725 A1 * 11/2010 Arbouw ..... F41A 9/62 342/357.51
2011/0000120 A1 * 1/2011 Thompson ..... F41C 27/00 42/84
2011/0010979 A1 * 1/2011 Houde-Walter ..... F41C 27/00 42/84
2011/0030257 A1 * 2/2011 Gwillim, Jr. ..... F41A 9/62 42/1.02

(56) References Cited

U.S. PATENT DOCUMENTS

2011/0031928 A1* 2/2011 Soar ..... H04K 3/827 320/108
2011/0061284 A1* 3/2011 Cabahug ..... F41C 27/00 42/84
2011/0089894 A1* 4/2011 Soar ..... B60N 2/90 320/108
2011/0126622 A1* 6/2011 Turner ..... F41A 19/01 73/514.01
2011/0173865 A1* 7/2011 Compton ..... F41C 27/00 42/84
2011/0239354 A1* 10/2011 Celona ..... A42B 3/04 2/422
2011/0283585 A1* 11/2011 Cabahug ..... F41G 11/003 42/73
2012/0055061 A1* 3/2012 Hartley ..... F41C 23/16 42/84
2012/0144716 A1* 6/2012 Cabahug ..... F41C 23/22 42/84
2012/0180363 A1* 7/2012 Frascati ..... F41G 11/003 42/90
2012/0180364 A1* 7/2012 Berntsen ..... F41G 11/003 42/90
2012/0192476 A1* 8/2012 Compton ..... H04B 5/0037 42/84
2012/0266514 A1* 10/2012 Michal ..... F41G 1/34 42/90
2012/0285064 A1* 11/2012 Houde-Walter ..... F41A 35/00 42/72
2013/0036646 A1* 2/2013 Rubac ..... F41C 23/22 42/90
2013/0047482 A1* 2/2013 Mulfinger ..... H01R 13/24 42/84
2013/0047486 A1* 2/2013 Ding ..... F16B 2/12 403/381
2013/0061504 A1* 3/2013 Malherbe ..... F41G 11/003 42/84
2013/0104438 A1* 5/2013 Hines ..... F41G 11/003 42/84
2013/0104439 A1* 5/2013 Hines ..... F41G 11/003 42/84
2013/0185978 A1* 7/2013 Dodd ..... F41G 11/003 42/84
2013/0229716 A1* 9/2013 Thomas ..... G02B 23/105 359/804
2014/0007485 A1* 1/2014 Castejon, Sr. ..... F41G 1/35 42/117
2014/0047754 A1* 2/2014 Compton ..... F41G 11/00 42/84
2014/0059911 A1* 3/2014 Oh ..... F41C 23/16 42/114
2014/0130392 A1* 5/2014 Oh ..... F41C 23/22 42/84
2014/0184476 A1* 7/2014 McHale ..... F41G 3/06 345/8
2014/0290110 A1* 10/2014 Stewart ..... F41A 17/46 42/70.11
2014/0360073 A1* 12/2014 Stewart ..... F41A 17/08 42/70.11
2014/0360077 A1* 12/2014 Miller ..... F41C 27/00 42/84
2015/0020427 A1* 1/2015 Compton ..... F41G 11/003 42/71.01
2015/0041538 A1* 2/2015 Teetzel ..... F41G 3/06 235/404
2015/0115880 A1* 4/2015 Soar ..... F41C 23/22 320/108
2015/0241166 A1* 8/2015 Hines ..... F41G 11/003 42/75.02
2015/0285599 A1* 10/2015 Downing ..... H04W 4/30 89/1.11
2015/0300786 A1* 10/2015 Downing ..... F41G 9/00 235/404
2016/0018185 A1* 1/2016 Makohon ..... F41C 27/00 42/90
2016/0025462 A1* 1/2016 Downing ..... F41G 11/003 89/1.11
2016/0061560 A1* 3/2016 Saadon ..... F41G 1/35 42/72
2016/0209169 A1* 7/2016 Toole ..... F41G 1/36
2016/0216082 A1* 7/2016 Downing ..... F41G 3/06
2016/0327371 A1* 11/2016 Teetzel ..... F41C 23/16
2016/0377383 A1* 12/2016 Downing ..... F41G 9/00 42/111
2017/0010073 A1* 1/2017 Downing ..... F41C 27/00
2017/0122706 A1* 5/2017 Masarik ..... H04B 10/1143
2017/0205202 A1* 7/2017 Teetzel ..... F41C 27/00
2017/0212160 A1* 7/2017 Fulton ..... H02H 3/08
2018/0328698 A1* 11/2018 Miller ..... F41G 11/003
2019/0049221 A1* 2/2019 Zimmer ..... F41G 11/003
2019/0310051 A1* 10/2019 Cabahug ..... F41C 27/00
2019/0353461 A1* 11/2019 Neal ..... F41G 11/003
2019/0353462 A1* 11/2019 Neal ..... G02B 6/4206
2019/0376755 A1* 12/2019 Teetzel ..... F41A 17/066
2020/0033096 A1* 1/2020 Sabaldan Elpedes .... F41G 1/30
2020/0124383 A1* 4/2020 Miller ..... F41J 5/10
2020/0132414 A1* 4/2020 Shelton ..... F41G 11/003
2020/0141700 A1* 5/2020 Moseman ..... F41G 1/32
2020/0217613 A1* 7/2020 Hatcher ..... G08B 21/24
2020/0232737 A1* 7/2020 McClellan ..... F41G 3/06
2020/0355464 A1* 11/2020 Estes, III ..... F41A 17/063
2021/0088310 A1* 3/2021 Planck ..... F41G 11/003
2021/0140742 A1* 5/2021 Neal ..... G02B 6/4206
2021/0148667 A1* 5/2021 Boone ..... F41A 17/74
2021/0247159 A1* 8/2021 Galie ..... F41A 19/16
2021/0348862 A1* 11/2021 Noonan ..... F41C 23/16
2021/0372737 A1* 12/2021 Masarik ..... F41G 3/06
2021/0391892 A1* 12/2021 Ellena ..... H04B 3/54
2022/0065575 A1* 3/2022 Canty ..... H04N 23/66
2022/0074690 A1* 3/2022 Lloyd ..... H04Q 9/00
2022/0260335 A1* 8/2022 Williams ..... F41G 11/003
2023/0168068 A1* 6/2023 Fackler ..... F41G 11/003 42/124

* cited by examiner

MOUNTING RAIL FOR FIREARM

FIELD

The present disclosure concerns the field of firearms, more specifically a mounting rail and a firearm equipped with such a rail.

INTRODUCTION

Published patent document U.S. Pat. No. 8,091,265 B2 discloses a firearm with a 'picatinny rail'. This rail allows for the attachment of one or more accessories. This rail also comprises a printed circuit board that provides electrical contacts for one or more accessories requiring an electrical power supply. In this document, the printed circuit board is housed in a recess formed between two rows of attachment catches. The electrical contacts are arranged on a free surface of the printed circuit board between the two rows. However, this solution has the disadvantage that the printed circuit board is exposed to the outside. Moreover, the printed circuit board consists of less resistant materials such as resin and ductile conductive metals. Thus, the printed circuit board (PCB) may easily be damaged following one or more shocks. As a result, it must be regularly replaced in order to ensure that it performs to specification. Of even more critical significance, however, is the fact that a failure of this PCB may be particularly problematic in operation.

Lastly, the reduction of the cross-section of the attachment catches also causes stability and mechanical strength issues for the rail, and reduces the support surfaces for the accessories attached to it.

Picatinny rails for firearms have already been proposed in order to address this issue:

US2011/0010979 discloses a 'picatinny rail' in which recesses are arranged in the flat upper surface to allow for the passage of electrical connections, with each recess being positioned between opposite flanks belonging, respectively, to two catches directly adjacent to the recess or in a central portion of the flat surface that forms the top of a catch. However, the weakness of these two design alternatives is that the dimensions of the recesses are not compatible with larger electrical interfaces. Moreover, the rail consists of two pieces, which limits its strength.

WO2011/079233 discloses a 'picatinny rail' comprising holes arranged in the flat upper surface of the rail, with each hole being positioned between two opposite flanks of adjacent teeth. This solution has the same defects as that of the document discussed supra.

SUMMARY

The objective of the present disclosure is to address at least one of the disadvantages of the aforementioned prior art. More specifically, the objective of the present disclosure is to improve the protection of the PCB and/or improve the mechanical strength of the resultant rail.

The present disclosure concerns a mounting rail for a firearm, wherein the rail comprises at least one catch arranged one a flat upper surface of the rail, wherein the at least one catch serves as a means of fixation for at least one accessory, wherein the rail comprises a housing that extends longitudinally, wherein the housing serves to receive a PCB allowing for an electrical connection with the at least one accessory, characterized in that the housing is partially defined by at least one recess, the/each recess is arranged between two opposite flanks of the/each corresponding catch, and a top of the/each corresponding catch extends transversely on either side of a median plane of the rail above the recess.

In one advantageous embodiment of the present disclosure, the mounting rail comprises one or more of the following technical characteristics in any possible adequate combination:

- the/each recess opens onto the two opposite flanks of the corresponding catch;
- the/each recess is formed in the base of the corresponding catch;
- the/each recess has a ceiling arranged below the top of the/each corresponding catch;
- the ceiling of the/each recess is arranged at a height of between 10% and 60% of the height of the/each corresponding catch relative to a line at the base of the catch;
- the/each recess has a length greater than or equal to the thickness of the/each corresponding catch on the level of, or below, the line at the base of the catch;
- the length of the/each recess is between 100% and 120% of the thickness of the corresponding catch;
- the/each catch extends from a lower surface of the rail to the ceiling of the/each corresponding catch;
- the/each recess has a rectangular cross-section on a plane parallel to the flat upper surface and/or the lower surface of the rail;
- the/each recess extends along an axis perpendicular to the flat upper surface and/or the lower surface of the rail;
- the center of the/each recess coincides with the center of the/each corresponding catch along the axis perpendicular to the flat upper surface and/or the lower surface of the rail;
- the housing has a rectangular cross-section;
- the width of the housing is less than 80% or 60% of the width of the rail;
- the at least one catch comprises a series of catches distributed at a regular interval on the flat upper surface of the rail in the longitudinal direction;
- the rail comprises at least one attachment hole formed at one end or in an intermediate area of the rail;
- the at least one attachment hole is arranged on the level of an additional catch, wherein the original catch is hollow at its center;
- the housing is further defined by at least one area of the flat upper surface, wherein the at least one area is a flat surface adjacent to the corresponding catch;
- the mounting rail conforms to standard MIL-STD-1913 (Picatinny).

The present disclosure also concerns a firearm comprising a mounting rail and a PCB inserted in the housing of the rail, characterized in that the rail is a mounting rail according to the present disclosure.

The present disclosure may also concern a method for producing a mounting rail for a firearm. The method comprises a step of providing a rail, a step of machining to form catches regularly spaced apart on a flat upper surface, and a step of machining the lower surface, characterized in that some material is hollowed out so as to form at least one recess extending vertically from the lower surface of the rail to a ceiling arranged in one of the catches, wherein the recess has a length greater than the thickness of the corresponding catch at the level of the line at its base. Alternatively, the step of machining the lower surface may be carried out before that of the upper surface.

Generally, the advantageous embodiments of the respective subject-matter of the present disclosure are equally applicable to the other subject-matter of the present disclosure. To the extent possible, each object of the present disclosure can be combined with the others. The respective subject-matter of the present disclosure can also be combined with the embodiments in the description, which can also be combined with one another.

The measures proposed by the present disclosure are of value in that they facilitate the maintenance of the PCB. They make it possible to reduce the weight of the rail whilst making it more rigid. Moreover, they provide a rail with a one-piece structure that makes the weapon lighter whilst maintaining the same level of strength. By taking the measures proposed by the present disclosure, the electrical contacts on the printed circuit remain easily accessible for accessories without being exposed to a risk of damage.

BRIEF DESCRIPTION OF THE DRAWINGS

Other characteristics and benefits of this disclosure will be better understood by reference to the description and drawings.

DETAILED DESCRIPTION

Figure 1:
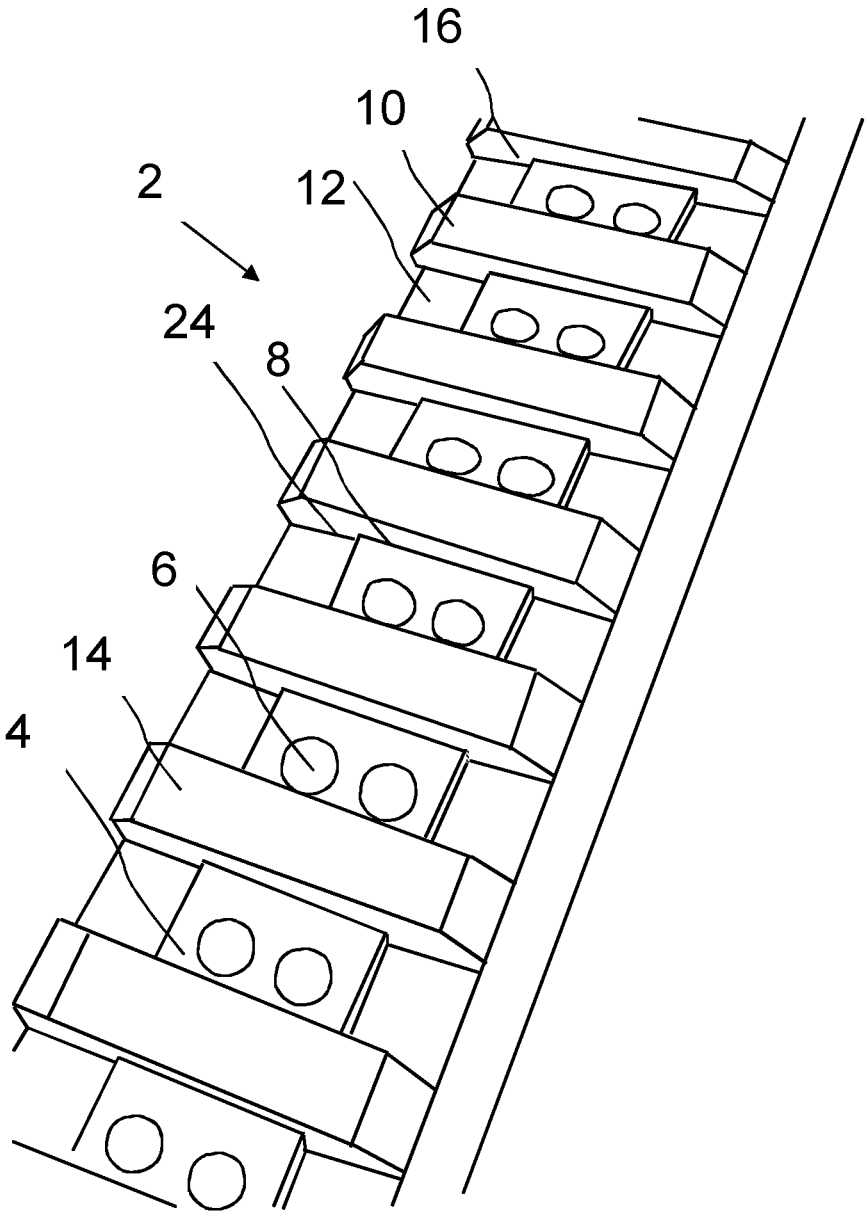
FIG. 1 is a schematic perspective view of the rail according to the present disclosure.

FIG. 1 is a perspective view of a mounting rail 2 according to the present disclosure. The rail 2 serves to support the attachment of one or more accessories that assist in firing, such as a laser aiming device. Certain accessories require a power supply and/or a data exchange connection. To this end, it is provided that a PCB 4 is included that comprises a series of electrical contact points 6. The PCB 4 is held within a sheath-shaped housing 8 arranged within the rail 2. The rail 2 has catches (or teeth) 10 distributed at a regular interval over a flat upper surface 12 of the rail 2 in a longitudinal direction. The flat upper surface 12 comprises flat surfaces that define hollow spaces between the catches 10. The catches 10 serve as a means of attachment for the one or more accessories. The catches 10 extend transversely on either side of a median plane of the rail 2. The PCB 4 is held within the housing 8. The sheath-shaped housing 8 is arranged partially in the bases of the catches 10. The tops 14 of the catches 10 serve as protection against any shocks. The tops 14 may each have a flat surface that is parallel to the flat upper surface 12 of the rail 2. The rail 2 may be mounted on a flat upper, lower, or lateral surface of a firearm (not shown), which may, for example, be a submachine gun.

Figure 2A:
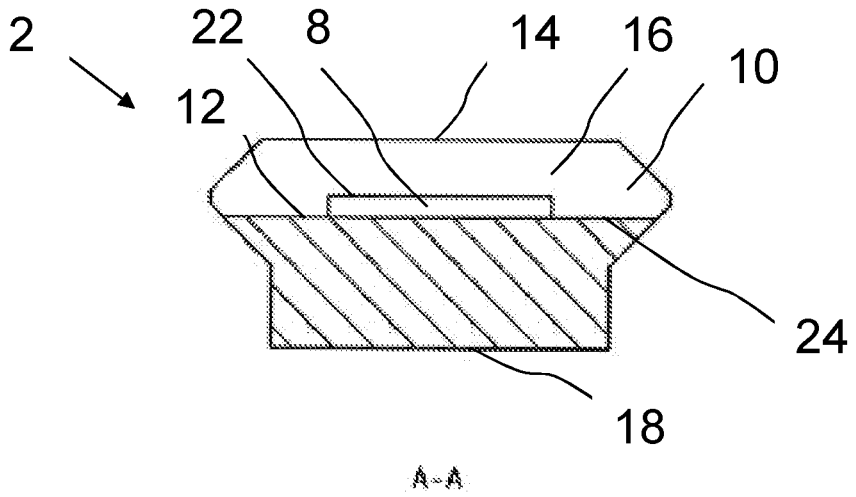
FIGS. 2*a* and 2*b* show a cross-section of the rail along the width of the rail at the level of a hollow area and top of a catch, respectively.
Figure 2B:
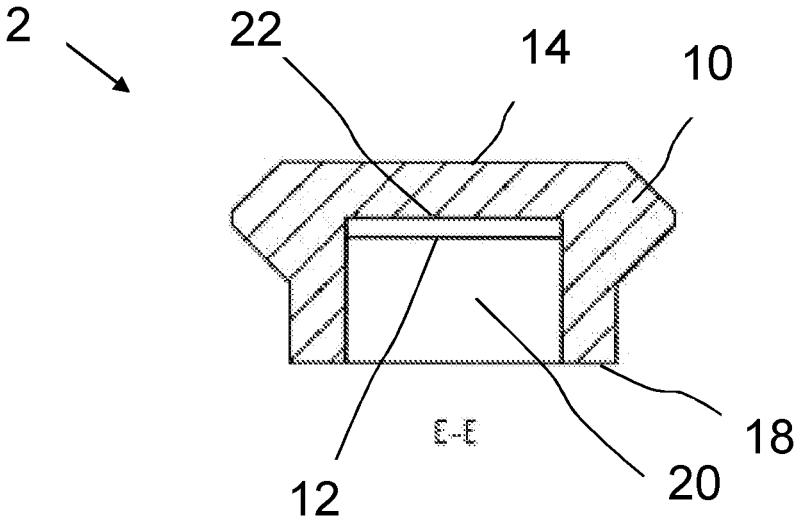

As shown in FIGS. 2*a* and 2*b*, the top of each catch 10 extends transversely on either side of the median plane of the rail 2, above the housing 8. The median plane of the rail 2 extends longitudinally, and is perpendicular to the flat upper surface 12. FIGS. 2*a* and 2*b* show a cross-section of the rail 2 along the width of the rail at the level of the hollow area and top 14 of a catch 10. As shown in FIGS. 2*a* and 2*b*, a recess 20 is formed in the base of the catch 10. The recess has a ceiling 22 arranged below the top 14 of the corresponding catch 10. Moreover, the recess 20 may have a rectangular cross-section in a plane parallel to the top surface 12 and/or a bottom surface 18 of the rail 2. The width of the housing may be less than 80 or 60% of the width of the rail 2. The ceiling 22 of each recess 22 may be arranged at a height between 10 and 60% of the height of the corresponding catch 10, relative to the line 24 at the base of the corresponding catch 10.

Figure 3:
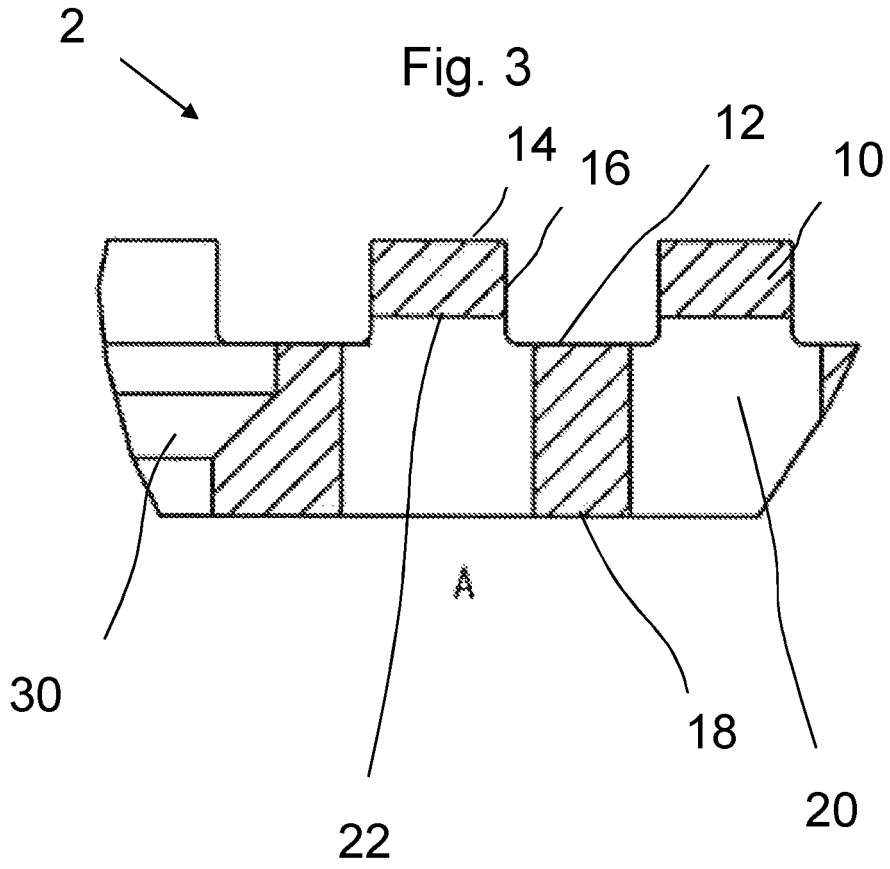
FIG. 3 shows a section through a median plane of the rail according to the present disclosure.

FIG. 3 shows that the housing 8 is defined in part by two recesses 20 arranged between two opposite flanks 16 of the corresponding catches 10. In FIG. 3, each recess 20 extends in the longitudinal direction between the two flanks of the corresponding catch 10. Likewise, each recess 20 extends vertically from the lower surface 18 of the rail 2 to the ceiling 22 of the corresponding catch 10. The length of each recess 20 is greater than the thickness of the corresponding catch 10 at the level of, and below, its baseline 24. The baseline 24 is defined by the intersection between the flanks 16 of the catch 10 in question and the upper flat surface 12. The housing 8 is further defined by areas of the flat upper surface 12. These areas correspond to the flat surfaces that define the hollow spaces between the catches. These areas are adjacent to the corresponding catches 10. Each area of the flat upper surface also serves to hold the PCB 4 in place. Each catch 10 may be rectangular in the median plane of the rail 2. Preferably, the center of each recess 20 coincides with the center of each corresponding catch 10 along an axis perpendicular to the upper surface 12. The length of the recess 20 may be between 100 and 120% of the thickness of the corresponding catch 10 at the level of its base or below it in the body of the rail 2.

Figure 4A:
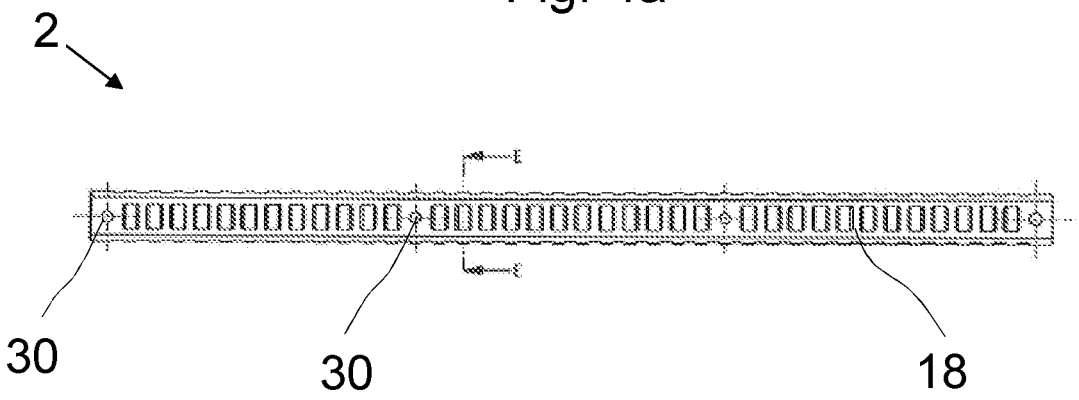
FIGS. 4*a*, 4*b*, and 4*c* show a top view, bottom view, and median section of the rail as a whole.
Figure 4B:
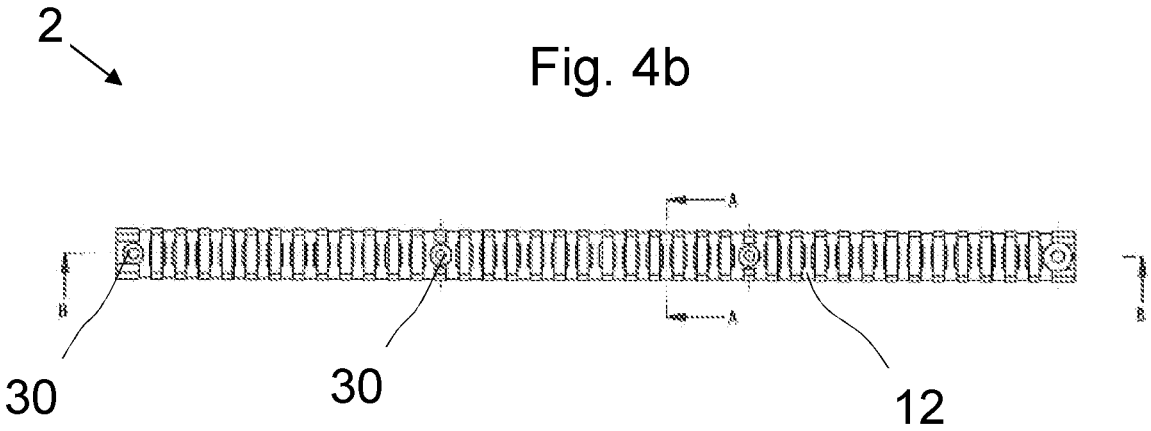
Figure 4C:
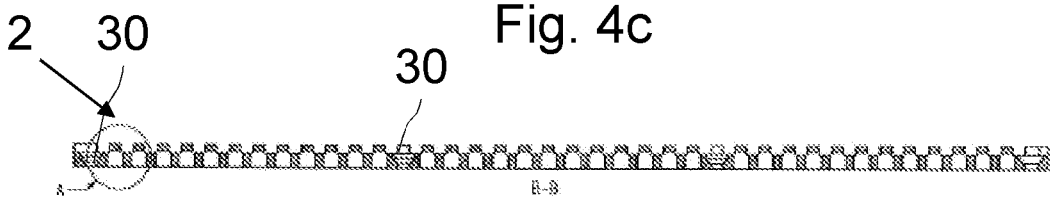

FIG. 4 shows top and bottom views, and a median section of the mounting rail 2 according to the present disclosure as a whole. The rail 2 may comprise attachment holes 30 formed, on the one hand, at the ends of the rail 2, and, on the other, in an intermediate area of the rail 2. The areas surrounding the holes 30 each have additional catches that may also serve as means of attachment for one or more accessories. These catches are recessed in their central part in order to form passages for the corresponding mounting screws.

The present disclosure may also concern a method of manufacture that is not shown. The method may comprise a step of providing a rail 2 having catches 10 formed on a flat upper surface 12 and spaced apart at a regular interval, and a step of machining the lower surface 18. During the machining step, a series of recesses 20 may be made by a single milling head of a machine tool or by multiple heads operating simultaneously. Each recess 20 in the material extends vertically from the lower surface 18 to the ceiling 22 arranged in the corresponding catch 10, with the ceiling 22 being positioned above the upper surface 12 and the recess 20 having a length greater than the thickness of the corresponding catch 10 at the level of its baseline 24. Advantageously, each recess 20 is centered on the associated catch 10 along an axis perpendicular to the upper surface 12. The machining may be carried out from top to bottom with the rail 26 mounted upside-down on its bench, or from bottom to top with the rail 26 mounted right-side up on its bench. During machining, the rail may be moving or fixed. Likewise, the step of machining the lower surface 18 may be carried out before that of the upper surface 18.

Furthermore, the description comprises embodiments of the present disclosure in accordance with the following clauses:

1. A mounting rail (2) for a firearm, wherein the rail (2) comprises at least one catch (10) arranged on a flat upper surface (12) of the rail (2), wherein the at least one catch (10) serves as a means of fixation for at least one accessory, wherein the rail (2) comprises a housing (8) that extends longitudinally, wherein the housing (8) is suited to receive a printed circuit board allowing for an electrical connection with the at least one accessory, characterized in that the housing (8) is partially defined by at least one recess (22), the/each recess (22) is arranged between two opposite flanks (16) of the/each corresponding catch (10), a top (14) of the/each corresponding catch (10) extends transversely on either side of a median plane of the rail (2) above the recess (8).

2. Rail (2) according to clause 1, characterized in that the/each recess (22) has a ceiling (22) arranged beneath the top (14) of the/each corresponding catch (10).
3. Rail (2) according to the foregoing clause, characterized in that the ceiling (22) of the/each recess is arranged at a height of between 10 and 60% of the height of the/each corresponding catch (10) relative to a line (24) at the base of the catch (10).
4. Rail (2) according to the foregoing clause, characterized in that the/each recess (20) has a length greater than or equal to the thickness of the/each corresponding catch (10) on the level of or below the line (24) at the base of the catch (10).
5. Rail (2) according to the foregoing clause, characterized in that the length of the/each recess (20) is between 100 and 120% of the thickness of the corresponding catch (10).
6. Rail (2) according to any of clauses 2-5, characterized in that the/each recess (20) extends from a lower surface (18) of the rail to the ceiling (22) of the/each corresponding catch (10).
7. Rail (2) according to the foregoing clause, characterized in that the/each recess has a rectangular cross-section on a plane parallel to the flat upper surface (12) and/or the lower surface (18) of the rail (2).
8. Rail (2) according to clause 6 or 7, characterized in that the/each recess (20) extends along an axis perpendicular to the flat upper surface (12) and/or the lower surface (18) of the rail (2).
9. Rail (2) according to clause 8, characterized in that the center of the/each recess coincides with the center of the/each corresponding catch (10) along the axis perpendicular to the flat upper surface (12) and/or the lower surface (18) of the rail (2).
10. Rail (2) according to any of the foregoing clauses, characterized in that the housing (8) has a rectangular cross-section.
11. Rail (2) according to any of the foregoing clauses, characterized in that the width of the housing (8) is less than 80 or 60% of the width of the rail (2).
12. Rail (2) according to any of the foregoing clauses, characterized in that the at least one catch (10) comprises a series of catches (10) distributed at a regular interval on the flat upper surface (12) of the rail (2) in the longitudinal direction.
13. Rail (2) according to any of the foregoing clauses, characterized in that the rail (2) comprises at least one attachment hole (30) formed at one end of, or in an intermediate area of, the rail (2).
14. Rail (2) according to the foregoing clause, characterized in that the at least one attachment hole (30) is arranged at the level of an additional catch, wherein the catch (10) is hollow in its center.
15. Firearm comprising a mounting rail (2) and a printed circuit board (4) inserted in the housing (8) of the rail (2), characterized in that the rail (2) is a rail (2) according to any of clauses 1-13.
16. Rail (2) according to any of clauses 1-14, characterized in that the/each recess (20) opens onto the two opposite flanks (16) of the corresponding catch (10).
17. Rail (2) according to any of clauses 1-14 or 16, characterized in that the/each recess (20) is formed in the base of the corresponding catch (10).

The invention claimed is:

1. A mounting rail for a firearm, wherein the rail comprises:

at least two catches arranged on a flat upper surface of the rail, wherein the at least two catches serve as a means of fixation for at least one accessory, wherein the rail comprises a housing that extends longitudinally in a longitudinal direction, wherein the housing is adapted to receive a printed circuit board configured to provide an electrical connection with the at least one accessory, wherein the housing is partially defined by at least two recesses, each recess is arranged between and opens onto two opposite flanks of the corresponding catch, such that a top of the corresponding catch extends transversely on either side of a median plane of the rail above the recess, and in that each recess has a ceiling arranged beneath the top of the corresponding catch;

wherein the ceiling of each recess is disposed at a height of between 10% and 60% of the height of the corresponding catch relative to a line at a base of the catch, wherein the line is defined by an intersection of one of the two opposed flanks and the upper surface;

wherein each recess extends from a lower surface of the rail to the ceiling.

2. The mounting rail of claim 1, wherein each recess has a length between two opposed walls defining the recess in the longitudinal direction greater than or equal to a thickness of the corresponding catch, in the longitudinal direction, on the level of the line at the base of the catch.

3. The mounting rail of claim 2, wherein the length of each recess is between 100% and 120% of the thickness of the corresponding catch.

4. The mounting rail of claim 1, wherein each recess has a rectangular cross-section on a plane parallel to the flat upper surface and/or the lower surface of the rail.

5. The mounting rail of claim 1, wherein each recess extends along an axis perpendicular to the flat upper surface and/or the lower surface of the rail.

6. The mounting rail of claim 5, wherein the center of each recess coincides with the center of the corresponding catch along the axis perpendicular to the flat upper surface and/or the lower surface of the rail.

7. The mounting rail of claim 1, wherein the housing has a rectangular cross-section.

8. The mounting rail of claim 1, wherein a width of the housing is less than 80% of a width of the rail.

9. The mounting rail of claim 1, wherein the at least two catches comprise a series of catches distributed at regular intervals on the flat upper surface of the rail in a longitudinal direction.

10. The mounting rail of claim 1, wherein the rail comprises at least one attachment hole formed at one end of, or in an intermediate area of, the rail.

11. The mounting rail of claim 10, wherein the at least one attachment hole is arranged at the level of an additional catch, wherein the catch is hollow in its center.

12. A firearm comprising:

the mounting rail of claim 1; and a printed circuit board inserted in the housing of the rail.

13. The firearm according to claim 12, wherein the printed circuit board extends over an entire width of the housing.

* * * * *